US005907961A

United States Patent [19]

Lee et al.

[11] Patent Number: 5,907,961

[45] Date of Patent: Jun. 1, 1999

[54] TEXTILE WET PROCESSING APPARATUS

[75] Inventors: Eric C. S. Lee, Charlotte, N.C.; On Kat Tsui, Lions Bay, Canada

[73] Assignee: Man Fung International, Ltd., Charlotte, N.C.

[21] Appl. No.: 08/874,571

[22] Filed: Jun. 13, 1997

[51] Int. Cl.[6] ..... D06B 3/30

[52] U.S. Cl. ..... 68/140; 68/143; 68/152; 68/207; 68/210

[58] Field of Search ..... 68/143, 140, 207, 68/210, 27, 148, 152, 158

[56] References Cited

U.S. PATENT DOCUMENTS

| | | | |
|---|---|---|---|
| 687,374 | 11/1901 | Hamer | 68/152 |
| 1,060,954 | 5/1913 | Skitt | 68/58 |
| 1,665,118 | 4/1928 | Thompson et al. | 68/143 |
| 1,781,217 | 11/1930 | Clover | 68/143 |
| 1,838,559 | 12/1931 | Lowe | 68/143 X |
| 1,937,276 | 11/1933 | Jenks | 68/143 X |
| 1,991,803 | 2/1935 | Hubbell | 68/143 |
| 2,938,367 | 5/1960 | Sulzmann | 68/143 X |
| 4,391,109 | 7/1983 | Grenier | 68/143 X |

FOREIGN PATENT DOCUMENTS

| | | | |
|---|---|---|---|
| 867650 | 8/1941 | France | 68/143 |
| 6966 | 1/1987 | Japan | 68/148 |

OTHER PUBLICATIONS

Mr. Tsui, On Kat & Dr. Eric CLS. Lee; No Title; No Title of Item; Feb. 12, 1948 (This is listed as a birthday, and is not necessarily a publication date; One page; No publisher; No country of publication; No source.

No Author; "Dyeing Equipment Categorization"; *Textile Dyeing Operations*; No publication date; pp. 275–283; No publisher; No country of publication; No source.

No Author; "Not All Jeans are Created Equal"; *American Dyestuff Reporter*; Sep. 1996; p. 61; No publisher; No country of publication; No source.

No Author; "Complete line of Wet Processing machines for piece dyeing and denim brushing"; *Tonello*; No date; p. 63; Speizman Industries, Inc. and Tonello s.r.l.; No country of publication; No source.

No Author; "The Best Value, Short and Long Term"; *Braun*; No date; One page; Braun; No country of publication; No source.

*Primary Examiner*—Philip R. Coe
*Attorney, Agent, or Firm*—Adams Law Firm, P.A.

[57] ABSTRACT

A textile wet processing machine, including a vessel for containing processing liquids therein for processing textiles, a drum mounted within the vessel on an axis perpendicular to the vertical for rotation therein, a motor operating through a drive train for rotating the drum in the vessel and a plurality of textile holders carried by the drum. The holders are positioned around the periphery of the drum for containing the textiles to be processed as the drum and the holders are rotated successively through the liquid in the vessel. The holders may be baskets for containing apparel or apparel components, or fabric.

8 Claims, 6 Drawing Sheets

TEXTILE WET PROCESSING APPARATUS

TECHNICAL FIELD AND BACKGROUND OF THE INVENTION

This invention relates to a wet processing apparatus for wet processing of textile products. The invention has particular application to the dyeing and finishing of garments and garment components without abrading the textiles by repeated fabric-to-metal contact such as occurs in other types of fabric and piece-good processes such as jet and paddle dyeing. Other forms of textiles, such as yarn on packages and skeins can also be processed using the basic teachings of this application. The apparatus gently but effectively circulates the textile products into, through and out of the processing liquid. Maximum use is made of the space inside the apparatus to increase efficiency and reduce the dyeing ratio.

SUMMARY OF THE INVENTION

Therefore, it is an object of the invention to provide an apparatus and method for wet processing textile products.

It is another object of the invention to provide an apparatus and method for wet processing textile fabrics and garments.

It is another object of the invention to provide an apparatus and method for wet processing textile fabrics and garments which is both effective and gentle.

It is another object of the invention to provide an apparatus and method for bleaching and dyeing textile fabrics and garments.

It is another object of the invention to provide an apparatus and method for wet processing textile fabrics and garments which permits the textile products to be gently submerged into, moved through and removed from the processing liquid.

It is another object of the invention to provide an apparatus and method for wet processing textile fabrics and garments which permit the portion of the apparatus to be removed from the vessel for loading and unloading of the textile products.

These and other objects of the present invention are achieved in the preferred embodiments disclosed below by providing a textile wet processing machine, comprising a vessel for containing processing liquids therein for processing textiles, a drum mounted within the vessel on an axis perpendicular to the vertical for rotation therein, drive means for rotating the drum in the vessel and a plurality of textile holders carried by the drum. The holders are positioned around the periphery of the drum for containing the textiles to be processed as the drum and the holders are rotated successively through the liquid in the vessel.

According to one preferred embodiment of the invention, the holders comprise baskets having walls sufficiently foraminous to permit free flow of the processing liquid into contact with the textiles in the baskets.

Preferably, the vessel comprises a bottom vessel half having an annular bottom wall and a top vessel half having an annular top wall cooperatively engaging the bottom vessel half to form an enclosure within which the drum rotates, the top vessel half being removable from the bottom half for removal of the drum.

According to another preferred embodiment of the invention, the baskets each have an arcuate inner and arcuate outer wall, first and second parallel side walls and first and second outwardly diverging end walls.

According to yet another preferred embodiment of the invention, the drive means comprises an electric motor having a drive pulley, a driven pulley fixed to the drum for coaxial rotation therewith, and endless drive belt means interconnecting the drive pulley and the driven pulley for transferring power from the motor to the drum.

According to yet another preferred embodiment of the invention, the drive means includes gear reduction means for reducing the rpm of the motor.

According to yet another preferred embodiment of the invention, the apparatus includes a dosing tank connected to the vessel by conduit means for introducing processing agents into the vessel.

According to yet another preferred embodiment of the invention, the baskets are adapted for holding textile piece goods.

An embodiment of the method of wet processing textile piece goods according to the invention comprises the steps of providing a vessel for containing processing liquids therein for processing textiles; providing a drum mounted within the vessel on a longitudinally-extending axis for rotation therein, placing the textile products to be processed in a plurality of textile holders carried by the drum around the periphery of the drum and rotating the drum in the vessel to successively and repeatedly submerge the textile products in the processing liquid in the vessel.

According to one preferred embodiment of the invention, the textile products are textile piece goods.

According to another preferred embodiment of the invention, the step of rotating the drum comprises rotating the drum about an axis perpendicular to the vertical.

According to yet another preferred embodiment of the invention, the method includes the step of removing the drum from the vessel in order to load and unload the textile holders.

Preferably, the holders comprise baskets having walls sufficiently foraminous to permit free flow of the processing liquid into contact with the textiles in the baskets.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
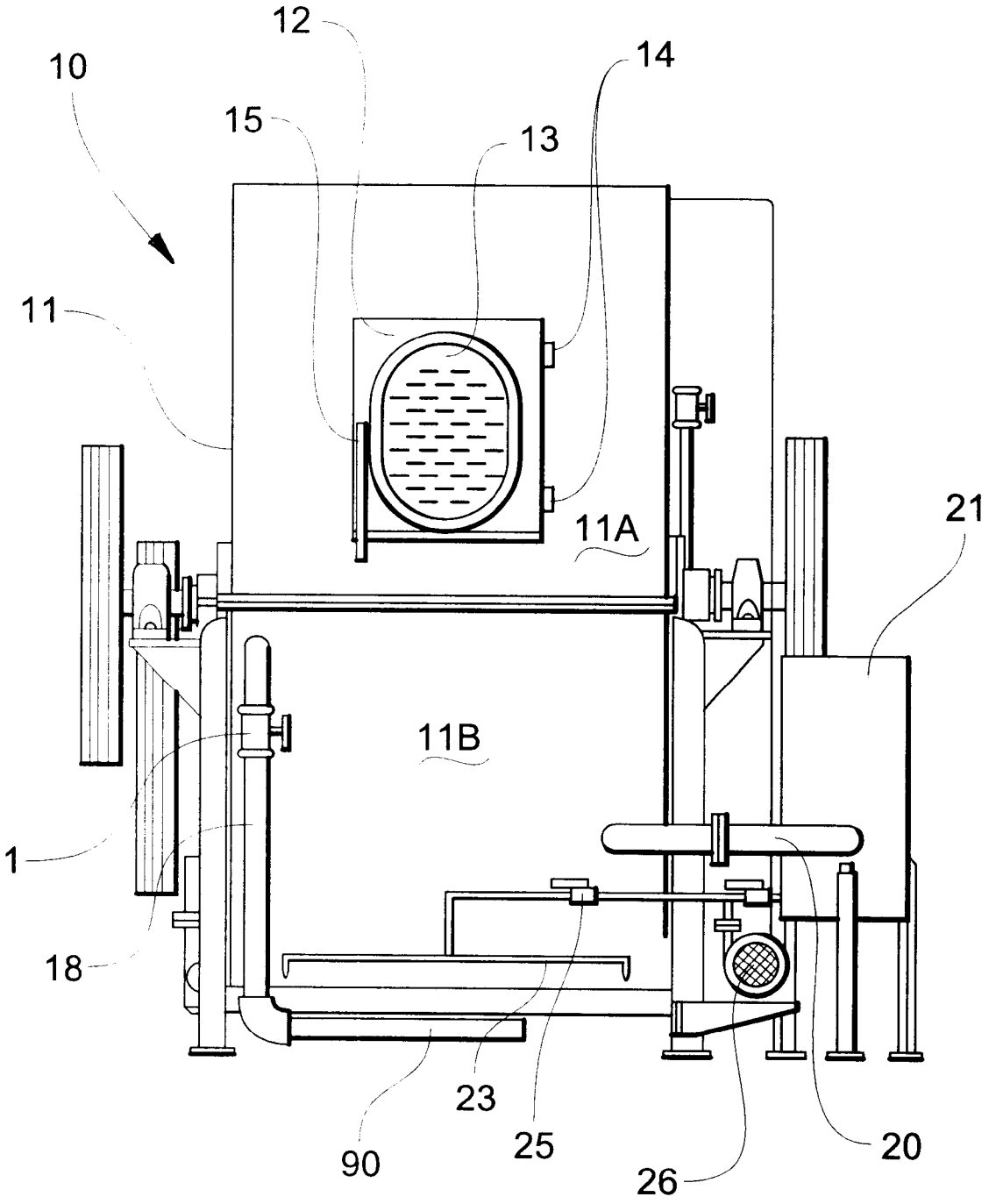
FIG. 1 is a front elevation of the textile wet processing apparatus according to a preferred embodiment of the invention.

Referring now specifically to the drawings, a textile wet processing apparatus according to the present invention is illustrated in FIG. 1 and shown generally at reference numeral 10. The textile wet processing apparatus 10 is preferably used to bleach, dye or otherwise wet process textile products, particularly apparel, apparel components or fabrics.

Textile wet processing apparatus 10 includes a vessel 11, which is formed from top and bottom vessel segments 11A and 11B. The top vessel segment 11A is formed of sheet stainless steel, and is essentially annular in cross-section, such that a vertical cross-section through the front-to-back axis of the textile wet processing apparatus 10 defines a semi-circle. The bottom vessel segment 11B is essentially the same size and shape as the top vessel segment 11A. Thus, the bottom vessel segment 11B functions as a container to receive and contain the processing liquids. The top vessel segment 11B functions as a cover so that the vessel is closed during operation. Typically, the top vessel segment 11A will be placed onto and removed from the bottom vessel segment by an overhead crane which lifts the top vessel segment 11A upwardly off of the bottom vessel segment 11B and sets it to one side while loading and unloading, and then lifts the top vessel segment 11A back onto the bottom vessel segment 11B when processing is ready to begin.

Top vessel segment 11A includes an observation door 12 which includes a window 13 through which operation of the textile wet processing apparatus can be observed without opening the door 12. Door 12 is hinged to the top vessel segment 11A by hinges 14. A latch handle 15 locks the door 12 when the door 12 is closed, and provides a means of opening the door 12 when desired.

An overflow pipe 18 prevents the level of liquid in the vessel 11 from reaching the top of the bottom vessel segment 11B, and a ball valve 19 permits the overflow pipe to be opened and closed as desired. A circulating pipe 20 circulates liquid between the vessel 11 and a feed tank 21 which holds dyes or other processing chemicals. A feed pipe 23 delivers dyes or other chemicals from the feed tank 21 to the vessel 11. A ball valve 25 controls the amount of chemicals fed to the vessel 11 from the feed tank 21. A pump 26 controls delivery of the dyes or other chemicals from the feed tank 21.

Figure 2:
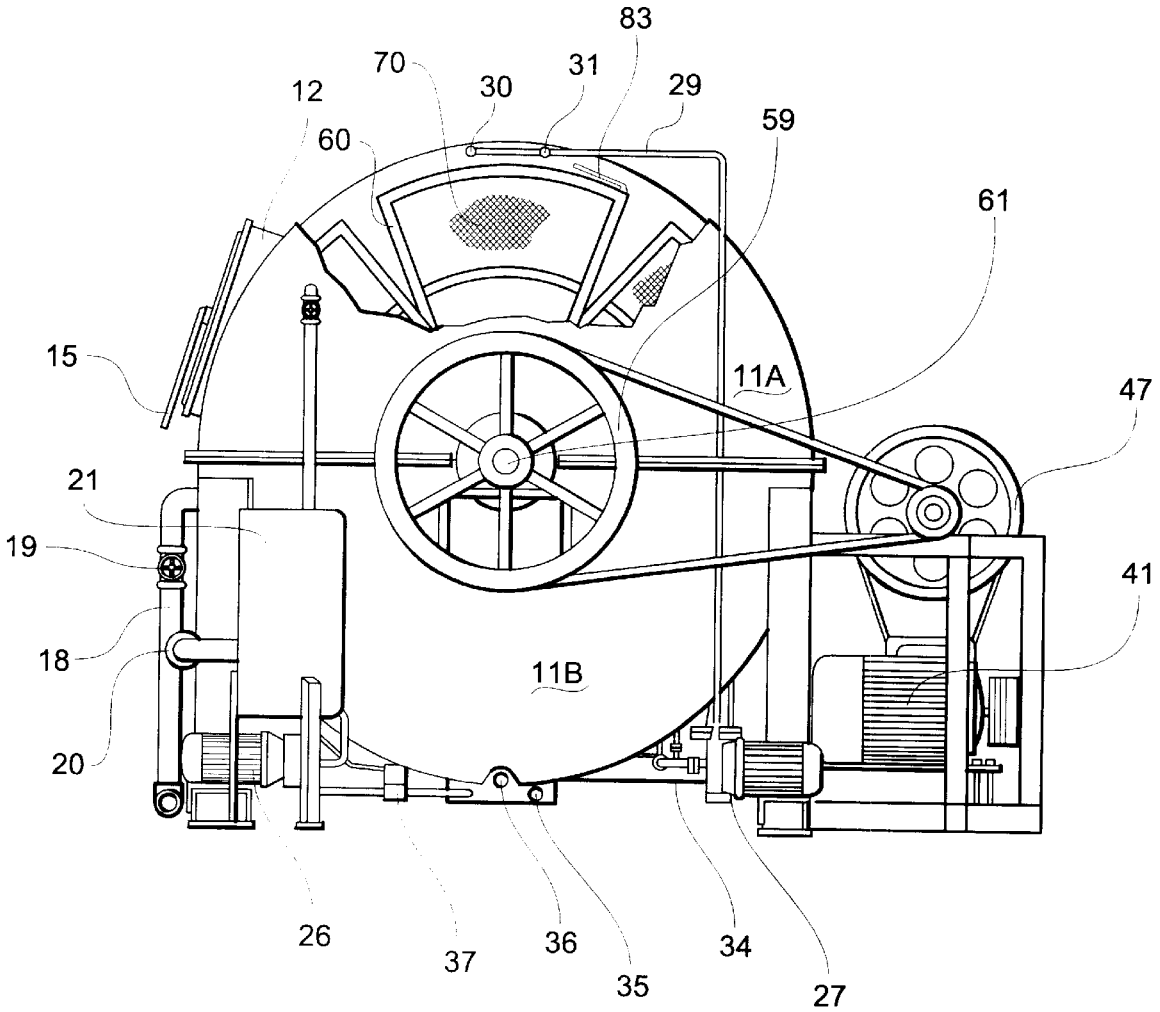
FIG. 2 is a right-side elevation with parts broken away of the textile wet processing apparatus shown in FIG. 1.

Referring now to FIG. 2, a water pump 27 supplies water through a one inch water pipe 29 to spray pipes 30 and 31 in the top of the top vessel segment 11A. This water spray is used to assist in rinsing the textile goods being processed, to vary the temperature of the textiles or to dilute the chemicals in the vessel 11. A temperature controller 33 controls the temperature of the water being delivered to the vessel 11. A steam pipe 35 and an open steam pipe 36 are controlled by a temperature control valve 37.

Figure 3:
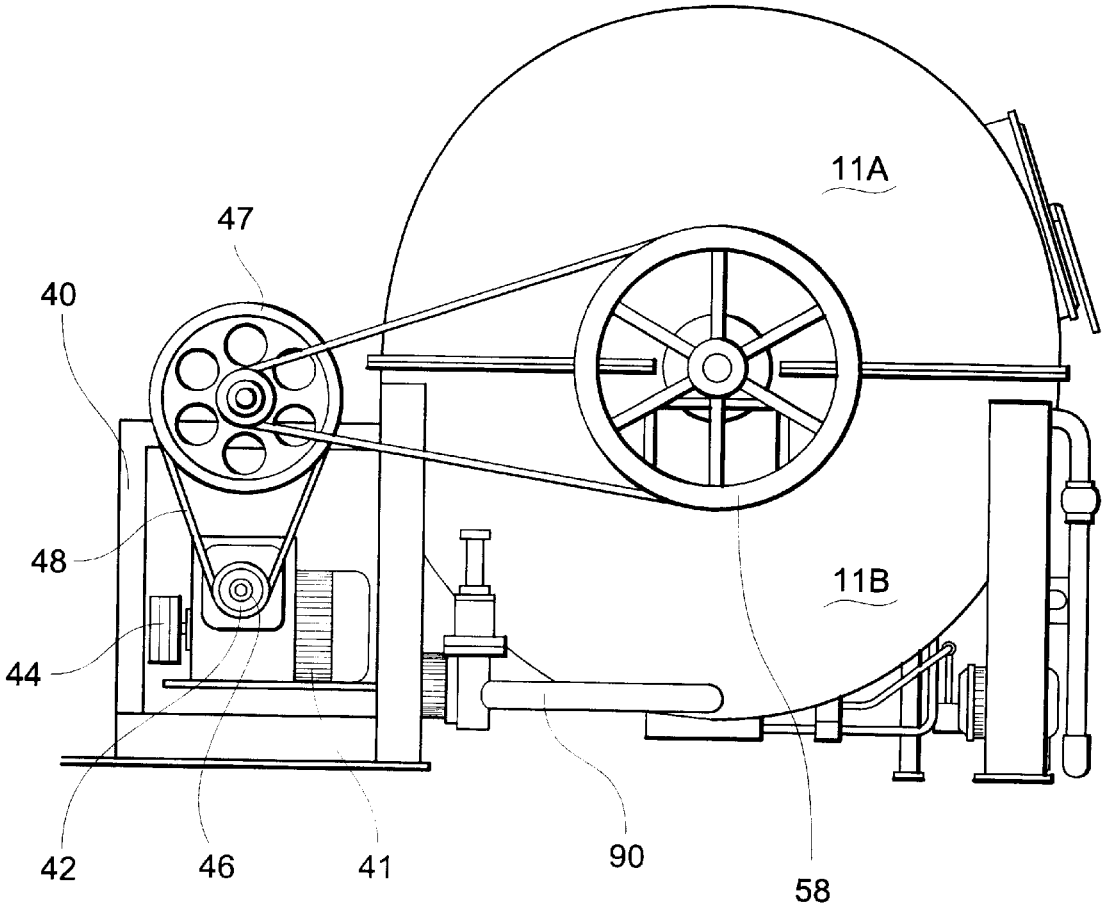
FIG. 3 is a left-side elevation of the textile wet processing apparatus shown in FIG. 1.
Figure 4:
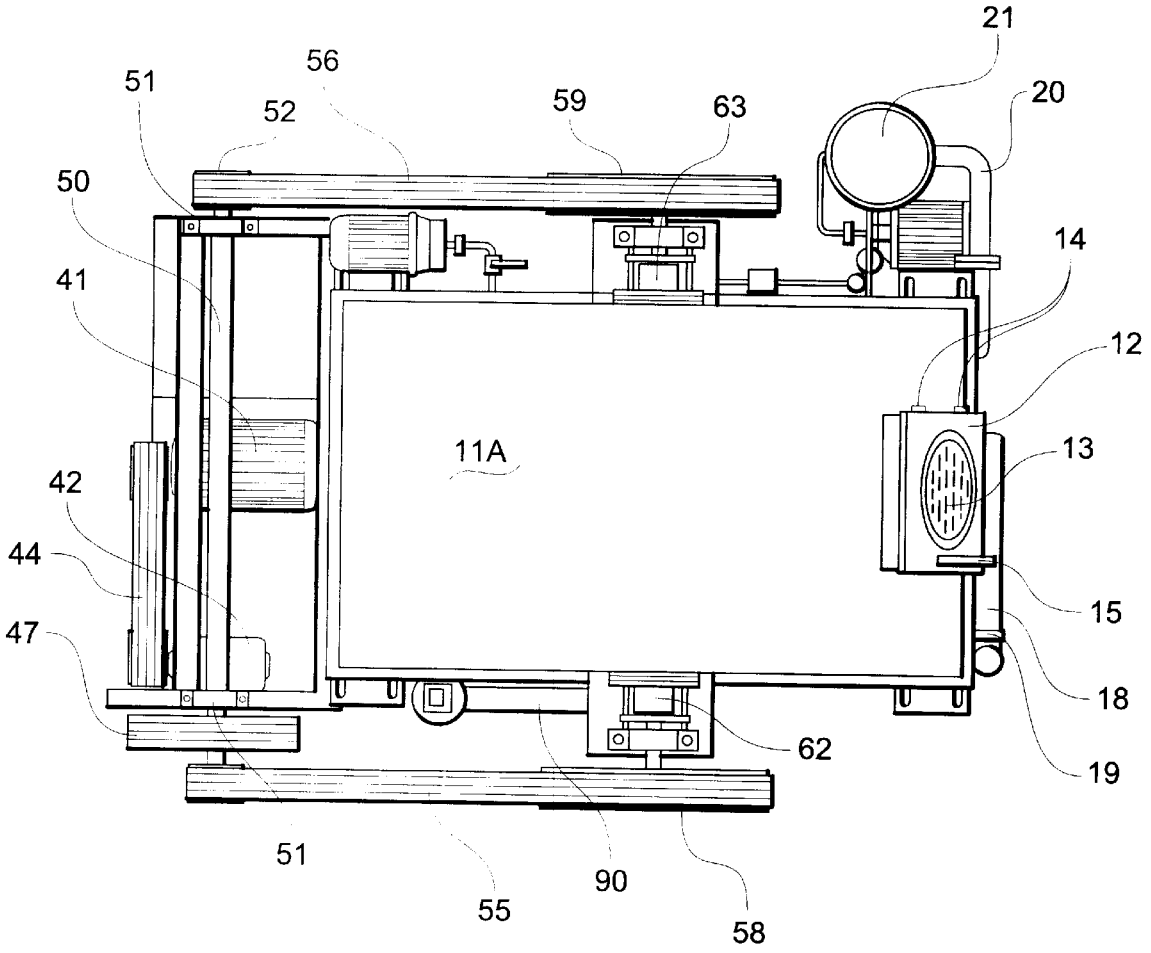
FIG. 4 is a top plan view of the textile wet processing apparatus shown in FIG. 1.

Referring now to FIGS. 3 and 4, a motor frame 40 mounts a main motor 41 which provides power to operate the textile wet processing apparatus 10. Motor 41 is connected to a gear reducer 42 through a motor pulley and belt assembly 44. The substantially reduced output rpm is transmitted from a drive pulley 46 on the output end of the gear reducer 42 to a drive shaft pulley 47. The drive shaft pulley 47 is mounted on a drive shaft 50 supported by drive shaft bearing assemblies 51. A drive shaft pulley 52 on the side of the drive shaft 50 opposite drive shaft pulley 47 permits power to be transmitted to both sides of the vessel 11, as described in further detail below. As is best shown in FIG. 4, main drive belt assemblies 55, 56 transmit power to a pair of drum drive pulleys 58, 59.

Figure 5:
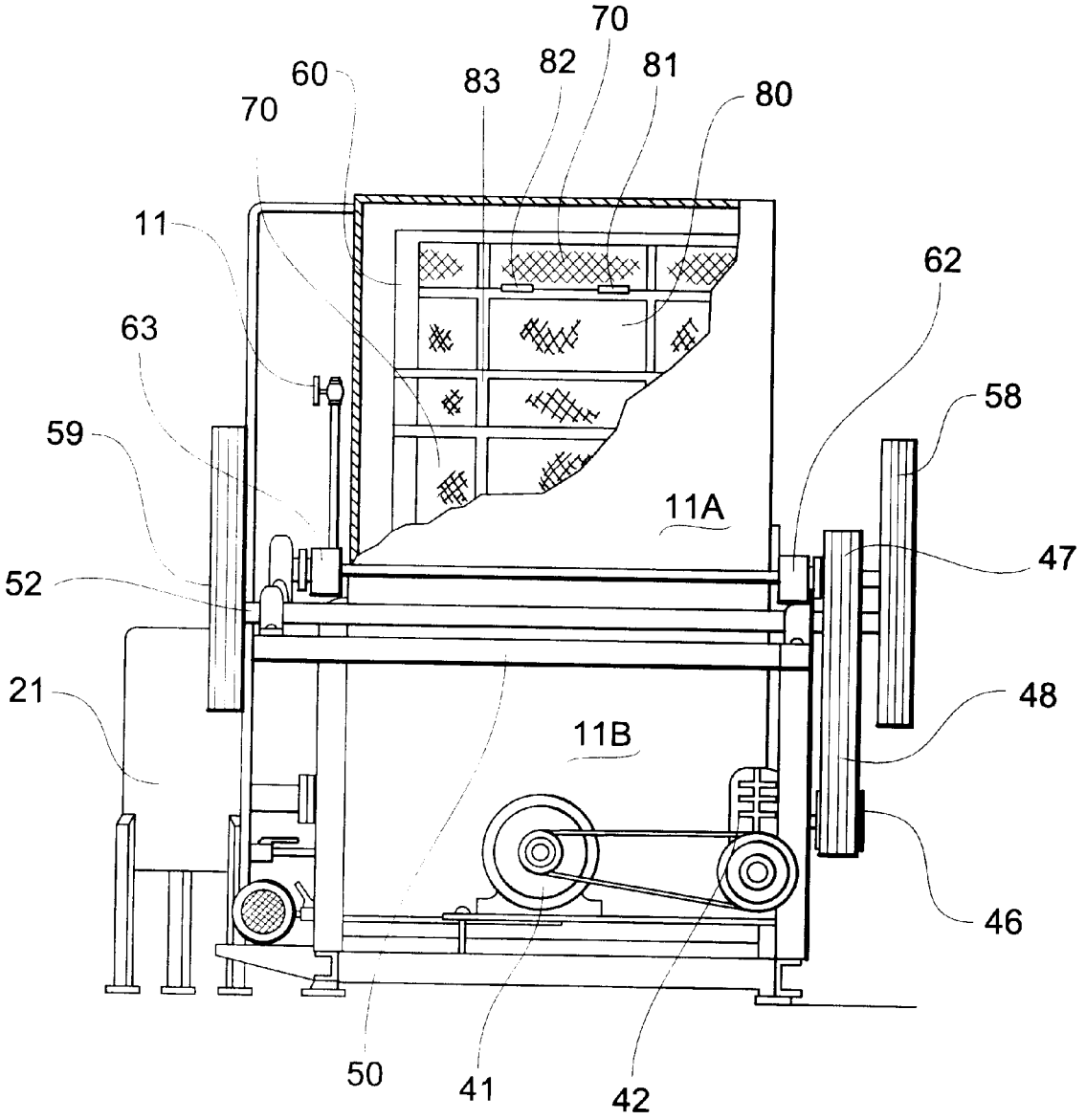
FIG. 5 is a rear elevation of the textile wet processing apparatus shown in FIG. 1, with parts broken away.

Referring now to FIG. 5, and with reference back to FIG. 2, a drum 60 is mounted for rotation within the vessel 11. The drum 60 is circular in cross-section and rotates on an axle 61. Drive pulleys 58, 59 are mounted on opposite ends of axle 61 and therefore rotate axle 61 and drum 60 by the power supplied from the motor 41. Through the various speed reductions accomplished by the gear reducer 42 and the relative sizes of the driven and drive pulleys, drum 60 preferably rotates at about 2 rpm.

Baskets 70 are secured to the outer peripheral frame of the drum 60 for containing the textile products to be processed. Preferably, six baskets 70, each accommodating approximately 60 degrees of arc of the drum 60 are positioned on drum 60, with a radial depth approximately 50 percent of the length of each basket 70 from front to back. The baskets are preferably fabricated from stainless steel strip stock to form a frame, and then covered with stainless steel wire or rod stock to form a foraminous structure as open as possible to permit maximum flow of the processing liquids into and out of the baskets 70 while containing the textile products.

Figure 6:
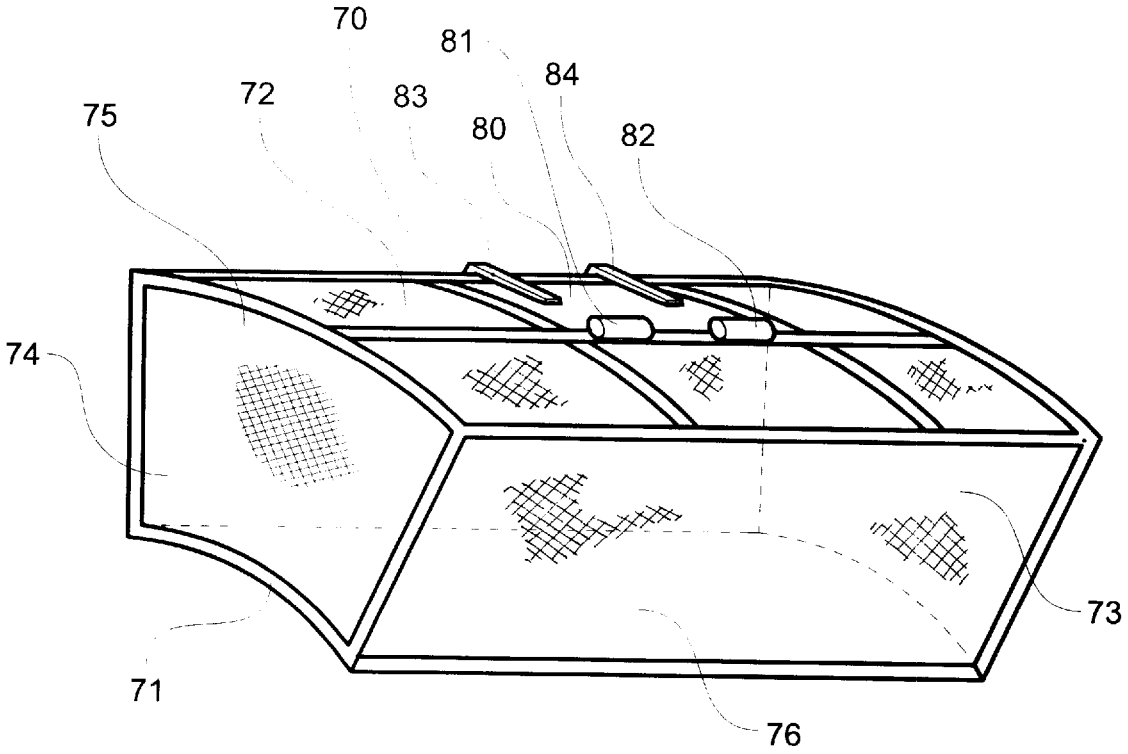
FIG. 6 is a perspective view of one of the baskets which contain the textile material during processing.

As is best shown in FIG. 6, each basket 70 has inner and outer arcuate walls 71, 72, first and second parallel side walls 73, 74, and first and second radially outwardly deverging end walls 75, 76. Each basket 70 forms a cage-like structure which in the preferred embodiment of the invention will hold approximately 23 Kg. (dry weight) of textile product. Thus, approximately 140 Kg. of textile products can be processed in a single load. Each basket 70 has an access door 80 pivotable on hinges 81 and 82 between open and closed positions. The door 80 is locked closed with over-center latches 83 and 84.

Spent liquids in the vessel 11 are drained through a drain 90.

The basket configuration described above is only one of several possibilities, and the shape of the basket is not considered critical. The shape described and illustrated for basket 70 is believed to take best advantage of the space available within the vessel 11.

The close conformation of the outer arcuate wall 72 to the inner, curved wall of the top vessel segment 11A in both spacing and shape enables maximum use to be made of the volume of the vessel 11. Dye liquor or other processing liquids substantially fill the bottom vessel segment 11B so that at any single time one-half of the textile products are submerged in the processing liquid. An important feature of the invention is that the gentle rotating action of the drum 60 and the containment of the textile products in a confined space within one of the six baskets 70. This prevents metal-to-fabric contact between the fabric and the metal parts of the vessel of the type which occurs when using jet-dyeing or paddle dyeing machines, where the fabric is pulled or pushed rapidly against metal surfaces. Fabric abrasion and pilling is therefore minimized or eliminated altogether. By moving the entire basket 70, the only significant relative motion is between the fabric and the liquid, not between the fabric and the walls of the vessel 11.

The efficient use of space permits a dyeing ratio of approximately 1:3.5—a substantial improvement over conventional bulk dyeing machines and processes. An example of the efficiencies obtained by the use of this process is illustrated below in the example.

EXAMPLE

Material

140 Kg. cotton garment body pieces and collars.

Dye formula

| | |
|---|---|
| Remafix Red F3B | 1.75% |
| Remafix Blue RS | .80% |
| Remafix Black B | .80% |
| Sodium sulfate | 50 g/l |
| Soda Ash | 20 g/l |

Liquor ratio

1:5

Dyeing procedure

The material was put in the apparatus 10 at a load rate of 23 Kg./basket. The apparatus 10 was run at a speed of 2 rpm. The material was scoured with Alcopol NA 2 1g/l; Caustic soda, 100%, 2 g/l; Cellesh 200, lg/l; Hydrogen peroxide 5 g/l, at room temperature for 10 minutes, heat at a rate of 1.5 degrees C. per minute to 90 degrees, maintain at 90 degrees for 15 minutes. Rinsed with warm water and then cold water, then neutralized with 0.5 g/l acetic acid.

Dying

The dyes were added into the machine through the feed tank gradually, then allowed to run for 10 minutes. Sodium sulfate was added gradually within 15 minutes and the system was allowed to run for 30 minutes. Soda ash was added gradually within 15 minutes, and the system was again allowed to run for 15 minutes. Temperature was raised to 60 degrees C. at 1.5 degrees per minute. The material was dyed for 45 minutes. After dyeing, the material was given two hot rinses, soap with Alcopol NA 2 g/l Cellesh 200 1 g/l at boil for 10 minutes B was then rinsed cold twice.

The material was checked for washing fastness by running an AATCC 2A wash test. The rating was 4–5.

A textile wet processing apparatus is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A textile wet processing machine, comprising:

(a) a vessel for containing processing liquids therein for processing textiles;

(b) a drum mounted within said vessel on an axis perpendicular to the vertical for rotation therein;

(c) drive means for rotating the drum in the vessel; and (d) a plurality of textile holders carried by said drum and adapted for containing the textiles to be processed as the drum is rotated and the holders thereby moved successively through the liquid in the vessel, said holders having respective radially-spaced inner and outer walls, opposing foraminous side walls, and opposing end walls, said inner walls engaging and collectively occupying approximately 360 degrees of the outer periphery of said drum, and a adjacent side walls of respective adjacent holders diverging from each other as they extend radially outwardly from said drum with the outer walls of said adjacent holders being circumferentially spaced-apart from each other to form a liquid flow gap between said adjacent holders, said flow gap increasing in size from the outer periphery of said drum to the outer walls of said adjacent holders thereby increasing liquid flow into and through said holders during processing.

2. A textile wet processing machine according to claim 1, wherein said holders comprise baskets having walls sufficiently foraminous to permit free flow of the processing liquid into contact with the textiles in the baskets.

3. An apparatus according to claim 1, wherein said vessel comprises a bottom vessel half having an annular bottom wall and a top vessel half having an annular top wall cooperatively engaging said bottom vessel half to form an enclosure within which the drum rotates, said top vessel half being removable from said bottom half for removal of the drum.

4. A textile wet processing machine according to claim 1 or 3, wherein said baskets each have an arcuate inner and arcuate outer wall, first and second parallel side walls and first and second outwardly diverging end walls.

5. A textile wet processing machine according to claim 1 or 3, wherein said drive means comprises:

(a) an electric motor having a drive pulley;

(b) a driven pulley fixed to the drum for coaxial rotation therewith;

(c) endless drive belt means interconnecting said drive pulley and said driven pulley for transferring power from said motor to said drum.

6. A textile wet processing machine according to claim 1 or 3, wherein said drive means includes gear reduction means for reducing the rpm of the motor.

7. A textile wet processing machine according to claim 1 or 3, and including a dosing tank connected to said vessel by conduit means for introducing processing agents into said vessel.

8. A textile wet processing machine according to claim 1 or 3, wherein said baskets are adapted for holding textile piece goods.

* * * * *